United States Patent [19]

Lewis

[11] Patent Number: 5,030,980

[45] Date of Patent: Jul. 9, 1991

[54] PHOTO DEVELOPMENT APPARATUS

[76] Inventor: John D. Lewis, 4 West Wayne St., Warren, Pa. 16365

[21] Appl. No.: 495,630

[22] Filed: Mar. 19, 1990

[51] Int. Cl.[5] ..... G03D 3/06

[52] U.S. Cl. ..... 354/299; 354/324

[58] Field of Search ..... 354/299, 313, 316, 320, 354/321, 322, 323, 324, 325, 328

[56] References Cited

U.S. PATENT DOCUMENTS

| | | | |
|---|---|---|---|
| 3,990,088 | 11/1976 | Takita | 354/324 X |
| 4,104,668 | 8/1978 | Laar | 354/299 |
| 4,429,983 | 2/1984 | Cortellino et al. | 354/320 |
| 4,712,899 | 12/1987 | Nishimoto | 354/316 |
| 4,757,338 | 7/1988 | Nishimoto et al. | 354/299 |

*Primary Examiner*—A. A. Mathews

*Attorney, Agent, or Firm*—Charles L. Lovercheck; Wayne L. Lovercheck; Dale Lovercheck

[57] ABSTRACT

A photo development apparatus made up of a development tank and a heater tank having an immersion heater in the heater tank. A flow means connects the development tank to the heater tank and a manifold connecting the heater tank to the development tank by means of a direction control means including a fitting directed at about 5 to 15 degrees to a radial line from opposite sides of the development tank so that an interference laminar flow is created in the development tank thereby providing agitation.

9 Claims, 2 Drawing Sheets

PHOTO DEVELOPMENT APPARATUS

BACKGROUND OF THE INVENTION

Apparatuses for continuously processing photographic film usually involves large quantities of liquid that has considerable thermal inertia and required relatively large and cumbersome apparatus. These apparatus are inconvenient and require an expensive amount of liquid to operate.

Most equipment available for lower volume processing requirements consists of one of the three following types:

1. Hand processing tank which will process film, mounted on a stainless steel reel, as long as there is latitude in the processing temperature requirements. Otherwise, the tank must be placed in a water jacket or bath, to assure proper temperature control.

2. A water jacket type tank consists of a large tank in which a series of small tanks is suspended. The large tank is filled with water either flowing at a constant temperature or tempered by an immersion heater. The film is mounted on reels suspended in the small tanks to be processed. This device allows for great accuracy in temperature control and very consistent results. The drawbacks are considerable because this unit needs constant running water, a large work area, and a heavy duty support.

3. Single drum (or rotating tank) type processing is possible for small quantities of film. However contamination and wet equipment become a problem when single drum type equipment is used for continuous processing.

4. The continuous processor is a large unit which transports the film through by the use of rollers or a web. This unit consists of an immersion heater mounted in each tank, a pump on the bottom of each tank (for circulating the processing solution), and a series of rollers used to transport the film through the tanks.

Many small professional photographers process film by hand due to the lack of fast and reliable processing equipment to meet their needs.

STATEMENT OF THE INVENTION

Disclosed herein is a novel device comprising the force of the pump, which, in creating a suction at the bottom of the tank, pulls the re-circulated fluid down towards the bottom of the tank through the film and reels that the film is attached to. This is the novel part of the process. This interference laminar flow constantly circulates fresh solution to all parts of the film evenly and without streaking.

Applicant has discovered that a very small (24×14×14) "dip and dunk" type tabletop film processing unit (capable of processing any existing roll or sheet film) which will circulate 3 pints of the solutions by pump and temper the solutions by direct contact of the solution with the heating device and control that temperature of the solution to within a range of 0.25 degrees. This unit also provides a novel manner of solution delivery to the film by interference laminar flow. This unit is rapid in access in that it will respond to heat the solutions from an ambient temperature to an operating temperature of 100° F. in less than 15 minutes. This unit provides a quick response to temperature change, when loaded with film and reels at room temperature, it compensates for the temperature change in less than 30 seconds not including the time for the temperature of the entire solution to change more than 0.25 to 0.50 degrees. Replenishment is accomplished by draining the required amount of liquid from the tank and refilling the tank. A small unit can be continuously operated. The unit is capable of running 8 rolls of 35 mm film per load, up to 4 loads per hour, (a larger unit will provide higher capacity). Processing results are consistent when the unit is replenished regularly based on the solution manufacturers specifications. The unit is easy to use by merely placing the reeled film in the tank from above and moving it from one tank to the next at the end of the required processing step. A bleach aerator is incorporated into the bleach tank as a standard feature.

The device shown herein comprises a square or round tank able to accommodate roll or sheet film that is mounted on a standard commercially available stainless steel or plastic reels or the film may be held on stainless steel hangers. The tank has an outlet on the bottom and multiple inlets within one to three inches of the top.

A centrifugal type pump, which is connected to the outlet of the above tank, is commercially available and is capable of changing the entire contents of the above tank in less than fifteen seconds.

A temperature sensor is located in the direct line exiting the pump and consists of a commercially available thermistor. The heater is an immersion heating device which is commercially available and may have a capacity of 100 or more watts of current input. The heating device is surrounded by a PVC enclosure or manifold at least twice the diameter of the heating device. The enclosure will allow the output flow of the pump to circulate in close proximity to the heating device, thus transferring the heat directly to the liquid, and allowing the fluid to exit by way of the multiple exit ports.

The return system is made up of commercially available tubing which will provide the fluid exit from the manifold back to the tank. A series of input openings for the return tubing to the original tank is provided. The nature of each opening is such that the line of flow from every other opening is negative 5 to negative 10 degrees from horizontal. Each opening between these openings is within 1 degree of horizontal. The liquid height is one to two inches above the return opening. The resulting injection of liquid forms what is herein termed interference laminar flow wherein the two opposing streams of liquid, from opposite sides of the tank flowing one over the other, set up a flow interference across the top of the liquid in the tank, thus providing a turbulence and a mixing action, without causing oxidation of the solutions therein.

OBJECTS OF THE INVENTION

It is an object of the invention to provide an improved film processing unit.

Another object is to provide a film processing unit that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

DETAILED DESCRIPTION OF THE DRAWINGS

Figure 1:
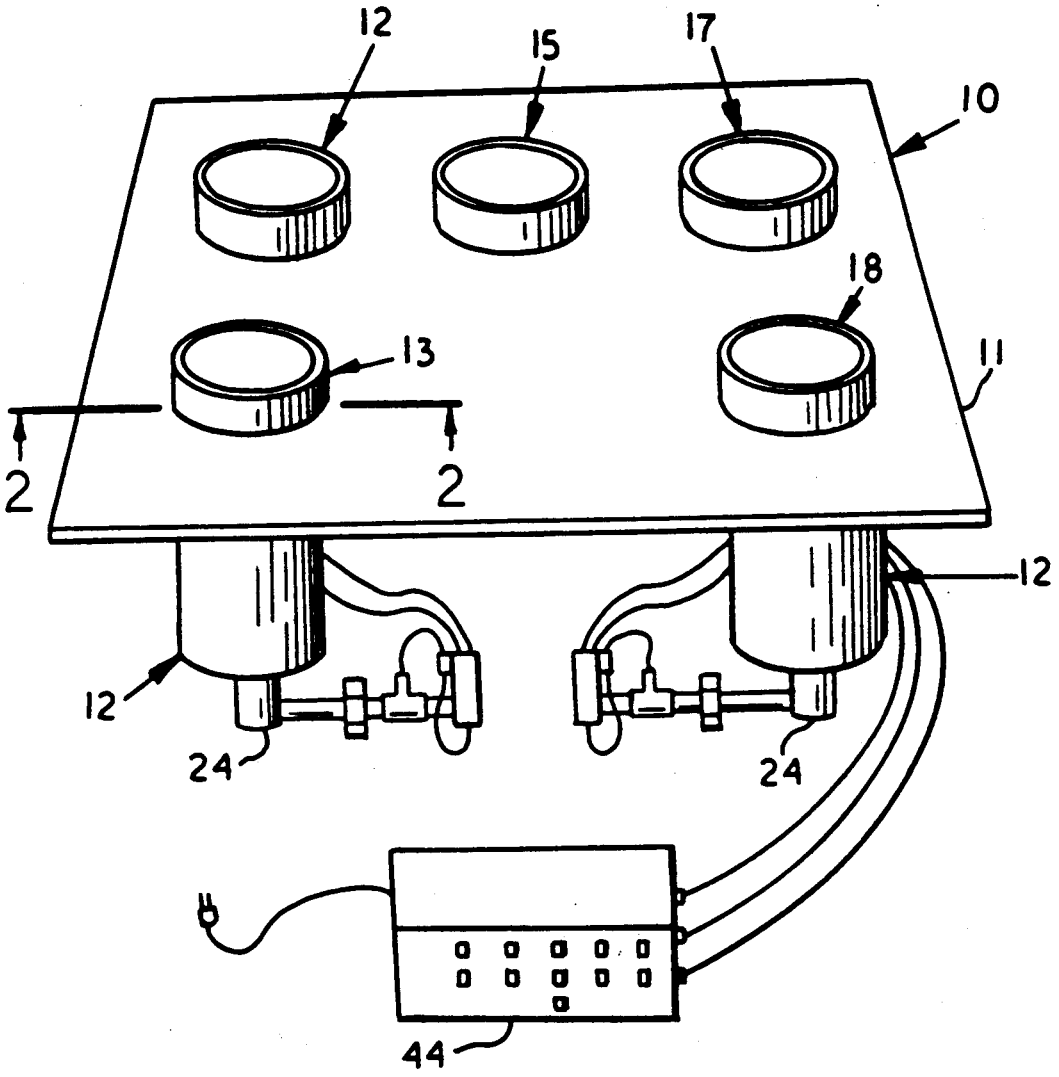
FIG. 1 is an isometric view of the film processing device according to the invention.

Now with more particular reference to the drawings, tabletop film processing unit 10 comprises table top 11, development tanks 12, 13, 15, 17 and 18 each having side walls 14, open top 16 and bottom 20. Tabletop 11 has spaced openings which receive development tanks 12, 13, 15, 17 and 18 respectively. Outlet opening 22 is provided in bottom 20 of development tank 12. Pump 24, of a centrifical type, is connected to outlet opening 22 by first line 19. Heater tank 32 is connected to pump 24 by first flow means 28 to temperature sensor 26, which is connected to heater tank 32 by second line 30. Heater tank 32 has first end 33 and a second end 31. Manifold 39, with manifold openings 40, is connected to second end 31 of heater tank 32 and contains immersion type heating unit 34. Heater control console 44 is connected to temperature sensor 26 through electrical heater lines 46 and connects power from power line 48 to immersion type heating unit 34.

Figure 2:
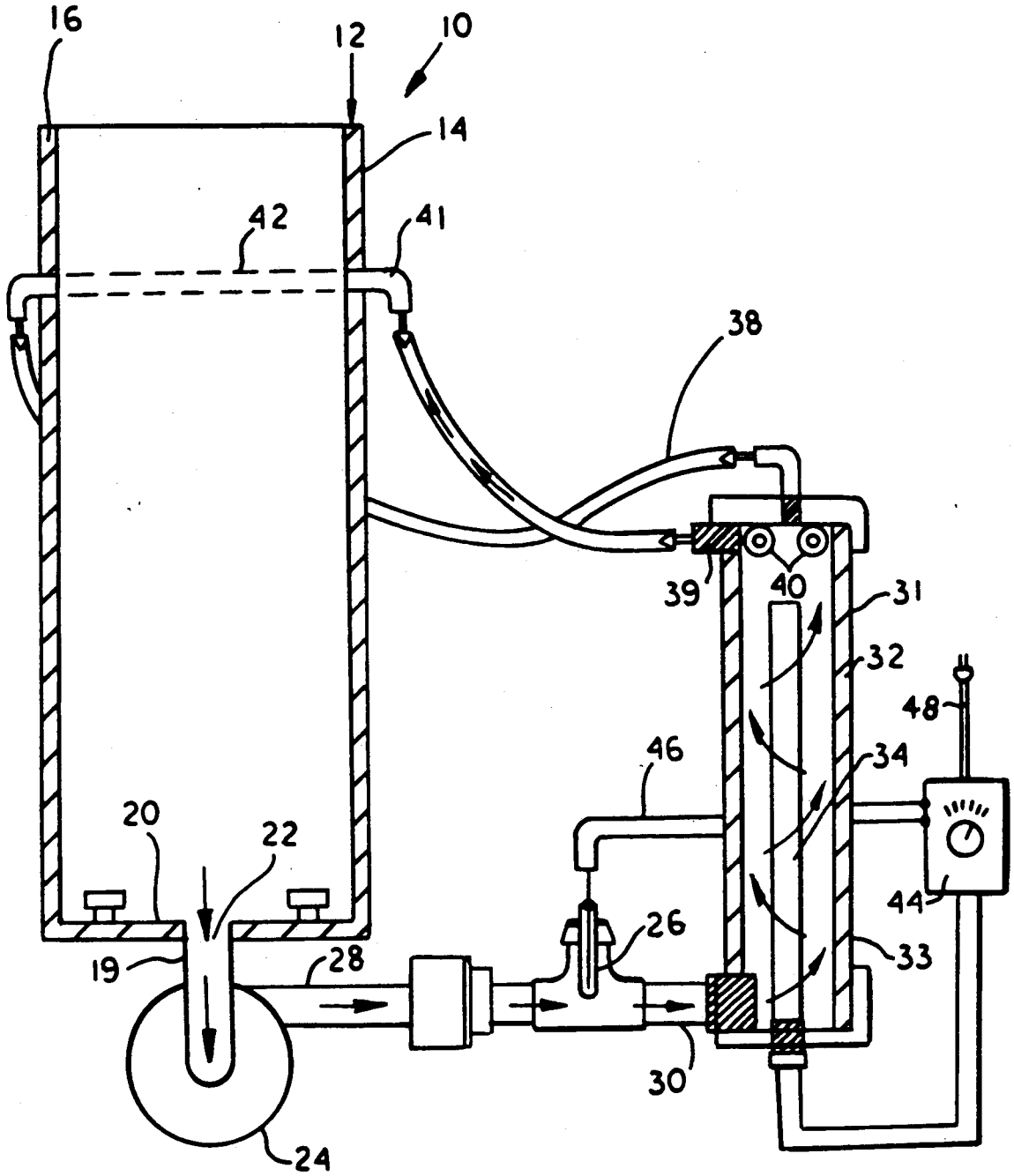
FIG. 2 is a cross-sectional view taken on line 2—2 of FIG. 1.

Development tanks 12, 13, 15, 17 and 18 are intended and tank 12 only is shown in FIG. 2 has inlet openings 42 spaced around their periphery. Inlet openings 42 are connected to manifold openings 40 in manifold 39 by means of manifold lines 38 and fittings 41. Fittings 41 are connected to side walls 14 of development tanks 12, 13, 15, 17 and 18. Fittings 41 are so oriented that developing liquid from fittings 41 enters development tank 12, 13, 15, 17 and 18 along a path from a particular one of inlet openings 42. Tanks 12 will be filled up to a suitable fill line. Inlet openings 42 are oriented such that every other inlet openings 42 around the periphery of development tank directs a stream of liquid along a path that is at an angle A of about 10 to 15 degrees above or below the stream of liquid from the inlet opening diametrically opposite thereto. Thus each alternate axis of inlet openings 42 are inclined to the horizontal between 10 to 15 degrees to one another. The resulting injection of liquid forms what is herein termed interference laminar flow. The two adjacent streams of developing liquid, one over the other, set up a flow interference across the top of the developing liquid in development tanks 12, 13, 15, 17 and 18. The force created by pump 24, in creating a suction at the bottom of development tanks 12, 13, 15, 17 and 18, pulls the re-circulated developing liquid down towards the bottom of development tank 12 through the film and reels that the film is attached to. This is the novel part of the process. This interference laminar flow constantly circulates fresh developing liquid around all the film in tank 12 to all parts of the film in the tank being processed, with the films being processed evenly and without streaking.

In use, the operator will fill one or more of development tanks 12, 13, 15, 17 and 18 with a developing liquid and turn on the power to power lines 48 and turn on pump 24. Within 15 minutes time, power from power line 48 will have heated the developing liquid in development tanks 12, 13, 15 and 17 and 18, and the developing liquid will be circulated into development tank 12 through manifold lines 38 flow from inlet openings 42 by interference laminar flow. When the chemical constituents of the relatively small development tanks 12, 13, 15, 17 and 18 has become exhausted, the development tanks 13, 15, 17 and 18 can be refilled with fresh developing liquid and the processing continued.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or priviledge is claimed are defined as follows:

1. A table top film processing unit comprising a development tank having a side wall, an open top and a bottom, an outlet opening in said bottom of said development tank, a pump, a first line connecting said outlet opening to said pump, a heater tank having a first end and a second end, a second line connecting said heater tank at said first end of said heater tank to said pump, a manifold connected to said heater tank at said second end of said heater tank said manifold having a plurality of manifold openings, said development tank having a plurality of spaced inlet openings adjacent said open top thereof and adjacent one another, a plurality of manifold lines, a plurality of directing means including fitting means connecting said manifold to said inlet openings whereby said pump circulates developing liquid from said development tank through said heater tank past an immersion heating unit and through said manifold lines to said inlet openings and said liquid flows into said development tank in a laminar flow manner, each said directing means directing said liquid solution into said development tank on a plurality of paths, each said path being directed at a predetermined angle above or below a said path adjacent thereto, said pump being adapted to create a suction at said development tank bottom pulling said liquid solution down toward said bottom of said development tank through a film and through reels of said film whereby interference laminar flow circulates fresh developing liquid solution to all parts of said film evenly and without streaking.

2. A film processing unit comprising a development tank having a side wall, a plurality of inlet openings circumferentially spaced in said side wall adjacent an open top of said development tank, an outlet opening at a bottom of said development tank, a pump a heater tank and a manifold, a first flow means connecting said pump to said heater tank, a heating means in said heater tank a heat sensing means connected to said first flow means controlling said heating means to regulate the temperature of a developing liquid in said heater tank to a close limit, a plurality of circumferentially spaced connecting means connecting said manifold to said development tank at said plurality of inlet openings, each said connecting means being adapted to direct a stream of said developing liquid into said development tank at along radial lines disposed at acute angles to one another and inclined to a horizontal at least 5 degrees different from the stream from said connecting means adjacent thereto whereby said developing liquid is directed in opposing streams one over the other in said development tank and thereby sets up a flow interference across said development tank.

3. The processing unit recited in claim 2 wherein a table top is provided and a plurality of development tanks extending through openings in said table top and said development tanks extend downward from said table top.

4. The processing unit recited in claim 3 wherein at least two said development tanks are provided extending through said table top spaced from one another.

5. The processing unit recited in claim 4 wherein a separate said manifold is connected to each said development tank and each said development tank is connected to a separate said pump.

6. The processing unit recited in claim 1 wherein said inlet openings are directed at an angle of about 10 degrees to a radial line of said development tank and from opposite sides so that an interference laminar flow is provided.

7. The processing unit recited in claim 4 wherein a separate pump and a separate heating unit are provided for each said development tank.

8. A film processing unit comprising a development tank, a heater tank, a pump, and a heat sensing means, said heater tank comprising an elongated container, said heater tank having a bottom and a top, a manifold having manifold openings connected to said top of said heater tank, a heater element supported on said bottom of said heater tank and extending toward said top, said development tank having a plurality of inlet openings in said development tank adjacent said top and a first connecting means including directing means connecting said manifold openings in said heater tank to said development tank whereby liquid from said inlet openings is projected into said development tank in paths which are directed in spaced patterns disposed at acute angles to one another whereby said liquid produces an interference laminar flow of said liquid in said development tank, a second connecting means connecting said pump to said bottom of said development tank and to said bottom of said heater tank.

9. The unit recited in claim 8 wherein said connecting means connecting said heater tank to said development tank comprises a temperature control unit for controlling the temperature of said liquid.

* * * * *